US007436244B2

(12) United States Patent
Lin

(10) Patent No.: US 7,436,244 B2
(45) Date of Patent: Oct. 14, 2008

(54) CIRCUIT FOR REFERENCE CURRENT AND VOLTAGE GENERATION

(75) Inventor: Chung-Wei Lin, Sinyuan Township, Pingtung County (TW)

(73) Assignee: Industrial Technology Research Institute, Hsinchu (TW)

( * ) Notice: Subject to any disclaimer, the term of this patent is extended or adjusted under 35 U.S.C. 154(b) by 66 days.

(21) Appl. No.: 11/393,132

(22) Filed: Mar. 29, 2006

(65) Prior Publication Data

US 2007/0040602 A1 Feb. 22, 2007

(30) Foreign Application Priority Data

Aug. 17, 2005 (TW) ..... 94127991 A

(51) Int. Cl.
*G05F 3/16* (2006.01)

(52) U.S. Cl. ..... 327/539; 327/540; 323/312

(58) Field of Classification Search ..... 327/535, 327/538–543; 323/312, 313, 314
See application file for complete search history.

(56) References Cited

U.S. PATENT DOCUMENTS

| | | | | |
|---|---|---|---|---|
| 4,857,823 | A | 8/1989 | Bitting | 323/314 |
| 5,367,249 | A | 11/1994 | Honnigford | 323/313 |
| 5,610,506 | A * | 3/1997 | McIntyre | 323/313 |
| 5,629,611 | A * | 5/1997 | McIntyre | 323/313 |
| 5,666,044 | A * | 9/1997 | Tuozzolo | 323/277 |
| 5,949,227 | A | 9/1999 | Bujanos | 323/313 |
| 5,955,873 | A * | 9/1999 | Maccarrone et al. | 323/314 |
| 6,018,235 | A * | 1/2000 | Mikuni | 323/313 |
| 6,191,644 | B1 * | 2/2001 | Srinath et al. | 327/539 |
| 6,351,111 | B1 * | 2/2002 | Laraia | 323/315 |
| 6,664,773 | B1 * | 12/2003 | Cunnac et al. | 323/277 |
| 6,815,941 | B2 * | 11/2004 | Butler | 323/313 |
| 6,946,825 | B2 * | 9/2005 | Tesi | 323/313 |
| 6,998,902 | B2 * | 2/2006 | Sugimura | 327/539 |
| 7,148,672 | B1 * | 12/2006 | Holmes | 323/316 |
| 2007/0146059 | A1 * | 6/2007 | Jo | 327/539 |

OTHER PUBLICATIONS

Gibilisco, Stan, The Illustrated Dictionary of Electronics, 2001, Eigth Edition, p. 491.*

Hironori Banba et al., "A CMOS Bandgap Reference Circuit with Sub-1-V Operation" IEEE journal of Solid-State Circuits, vol. 34, No. 5, May 1999, pp. 670-674.

Piero Malcovati et al., "Curvature-Compensated BiCMOS Bandgap with I-V Supply Voltage" IEEE Journal of Solid-State Circuits, vol. 36, No. 7, Jul. 2001, pp. 1076-1081.

* cited by examiner

*Primary Examiner*—N. Drew Richards
*Assistant Examiner*—Thomas J Hiltunen
(74) *Attorney, Agent, or Firm*—J.C. Patents

(57) ABSTRACT

A circuit for reference current and voltage generation is provided. The circuit comprises a current bias circuit and a voltage reference circuit. Wherein, the current bias circuit receives an enable signal, provides a reference current, a bias signal and a startup signal when the enable signal is in an enabling state, and provides a first predetermined voltage and a second predetermined voltage when the enable signal is in a disabling state. The voltage reference circuit is electrically coupled to the current bias circuit. In addition, the voltage reference circuit enters into a turned-on state and provides a reference voltage after receiving the bias signal and the enable signal, and enters into a turned-off state after receiving the first and the second predetermined voltages.

9 Claims, 4 Drawing Sheets

CIRCUIT FOR REFERENCE CURRENT AND VOLTAGE GENERATION

CROSS-REFERENCE TO RELATED APPLICATION

This application claims the priority benefit of Taiwan application serial No. 94127991, Aug. 17, 2005. All disclosure of the Taiwan application is incorporated herein by reference.

BACKGROUND OF THE INVENTION

1. Field of the Invention

The present invention relates to a circuit for reference current and voltage generation, and more particularly, to a circuit for reference current and voltage generation used in a hand-held electronic device.

2. Description of the Related Art

Since the application of hand-held electronic devices is more popular now, the requirement of the battery usage time is more demanded. How to reduce the power consumed by the electronic components in the hand-held electronic apparatus when it is in a stand-by or turned-off state had become a major subject of the current technology development. For the analog circuit, the static current consumed in the circuit for reference current and voltage generation is usually a technique bottleneck. Accordingly, it is desired to develop a new circuit for reference current and voltage generation, in which the circuit is easily turned on and off, and only a very small static current is consumed when it is in the turned-off state.

A circuit shown in FIG. 1 had been disclosed in U.S. Pat. No. 5,949,227, in which a startup circuit 101 is configured to turn on the voltage reference circuit 103, and a startup disabling circuit 102 is configured to isolate the startup circuit 101 and the voltage reference circuit 103 when the circuit in FIG. 1 is in the turned-off state. However, the startup disabling circuit 102 proposed in this patent cannot fully turn off the current. In other words, there is still some current consumption when the circuit is in the turned-off state.

A low voltage bandgap reference circuit had been disclosed in the thesis "A CMOS Bandgap Reference Circuit with Sub-1-V Operation" proposed by Hironori Banba and Hitoshi Shiga et al. in Journal of Solid-State Circuit, vol. 34, no. 5, pp. 670-674, May 1999. In the method for turning on the bandgap reference circuit proposed by this thesis, an n-channel metal oxide semiconductor field effect (NMOS) transistor and a power-on reset signal are used to start up the whole circuit when the electric power is just provided to the bandgap reference circuit. Even this thesis had proposed a method to implement the low voltage bandgap reference circuit and a method for turning on the circuit, a method for turning off the circuit was never mentioned.

Another thesis "Curvature-Compensated BiCMOS Bandgap with 1-V Supply Voltage" had proposed by Piero Malcovati and Franco Maloberti et al. in Journal of Solid-State Circuit, vol. 36, no. 7, pp. 1076-1081, July 2001. This thesis mainly proposed a method for designing an operational amplifier (OP AMP) in the bandgap reference circuit under low voltage and a method for turning on the circuit. However, a method for turning off the circuit is absent. In addition, a BiCMOS manufacturing process is required in the method for turning on the circuit mentioned above. In other words, the implementation of such a method requires a composite manufacturing process of bipolar junction (BJT) transistors and complementary MOS transistors (CMOS).

In summary, the current technique fails to fulfill our expectation.

SUMMARY OF THE INVENTION

Therefore, it is an object of the present invention to provide a circuit for reference current and voltage generation that provides complete turn-on and turn-off functions. The circuit hardly consumes any current when it is turned off, thus the usage time of the hand-held electronic apparatus is effectively extended, and the present invention can be embodied merely by the CMOS manufacturing process.

In order to achieve the object mentioned above and others, the present invention provides a circuit for reference current and voltage generation. The circuit comprises a current bias circuit and a voltage reference circuit. Wherein, the current bias circuit receives an enable signal, provides a reference current, a bias signal and a startup signal when the enable signal is in an enabling state, and provides a first predetermined voltage and a second predetermined voltage when the enable signal is in a disabling state. The voltage reference circuit is electrically coupled to the current bias circuit. The voltage reference circuit enters into a turned-on state and provides a reference voltage after receiving the bias signal and the enable signal, and enters into a turned-off state after receiving the first and the second predetermined voltages.

In an embodiment of the present invention, the current bias circuit in the circuit for reference current and voltage generation mentioned above comprises a startup circuit, a first isolator, a constant gm bias circuit, and a second isolator. Wherein, the startup circuit receives a state signal and provides a startup signal when the state signal is in the turned-off state. The first isolator receiving an enable signal also receives the startup signal from the startup circuit. The first isolator provides the startup signal when the enable signal is in an enabling state, and provides a third predetermined voltage when the enable signal is in a disabling state. The constant gm bias (or the constant transconductance bias) circuit electrically coupled to the first isolator provides a state signal to the startup circuit according to its current state. The circuit enters into the turned-on state and provides a reference voltage and a bias signal after receiving the enable signal from the first isolator, and enters into the turned-off state after receiving the third predetermined voltage from the first isolator. Finally, the second isolator receives the enable signal and transmits the bias signal provided by the constant gm bias circuit to the voltage reference circuit when the enable signal is in the enabling state, and transmits the startup signal provided by the first isolator to the voltage reference circuit. Contrarily, if the enable signal is in the disabling state, a first predetermined voltage and a second predetermined voltage are provided to the voltage reference circuit.

In an embodiment of the circuit for reference current and voltage generation according to the present invention, if the enable signal is in the disabling state, the startup circuit, the constant gm bias circuit, and the second isolator are isolated by the first isolator. In addition, the constant gm bias circuit, the first isolator, and the voltage reference circuit are isolated by the second isolator.

In accordance with a preferred embodiment of the present invention, in the present invention, a startup circuit is configured to turn on the constant gm bias circuit, and the startup circuit and a constant gm bias circuit are further configured to turn on a voltage reference circuit. Regarding to the turn-off function, in the present invention, a predetermined voltage provided by the isolator is used to turn off the constant gm bias circuit and the voltage reference circuit. Accordingly, the present invention can provide complete turn-on and turn-off functions.

Moreover, when the circuit is turned off, the isolator of the present invention isolates the startup circuit, the constant gm bias circuit, and the voltage reference circuit, which completely blocks the current. Accordingly, the circuit for reference current and voltage generation provided by the present invention does not consume any current when it is in the turned-off state, which significantly extends the usage time of the hand-held electronic apparatus. Furthermore, since the BJT transistor is not required in the present invention, the present invention can be embodied merely by the CMOS manufacturing process.

BRIEF DESCRIPTION DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION PREFERRED EMBODIMENTS

Figure 1:
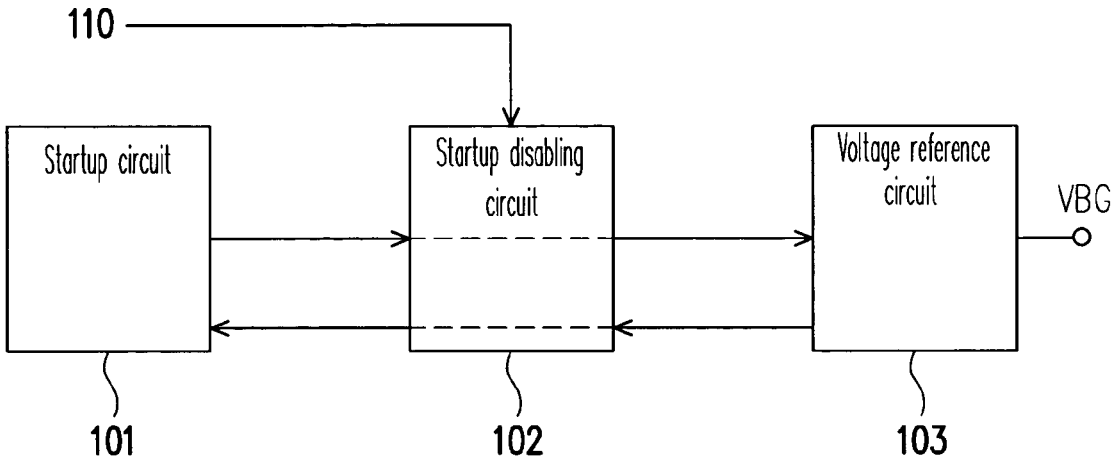
FIG. 1 (PRIOR ART)
FIG. 1 is a schematic circuit diagram of a conventional circuit for reference current and voltage generation.
Figure 2:
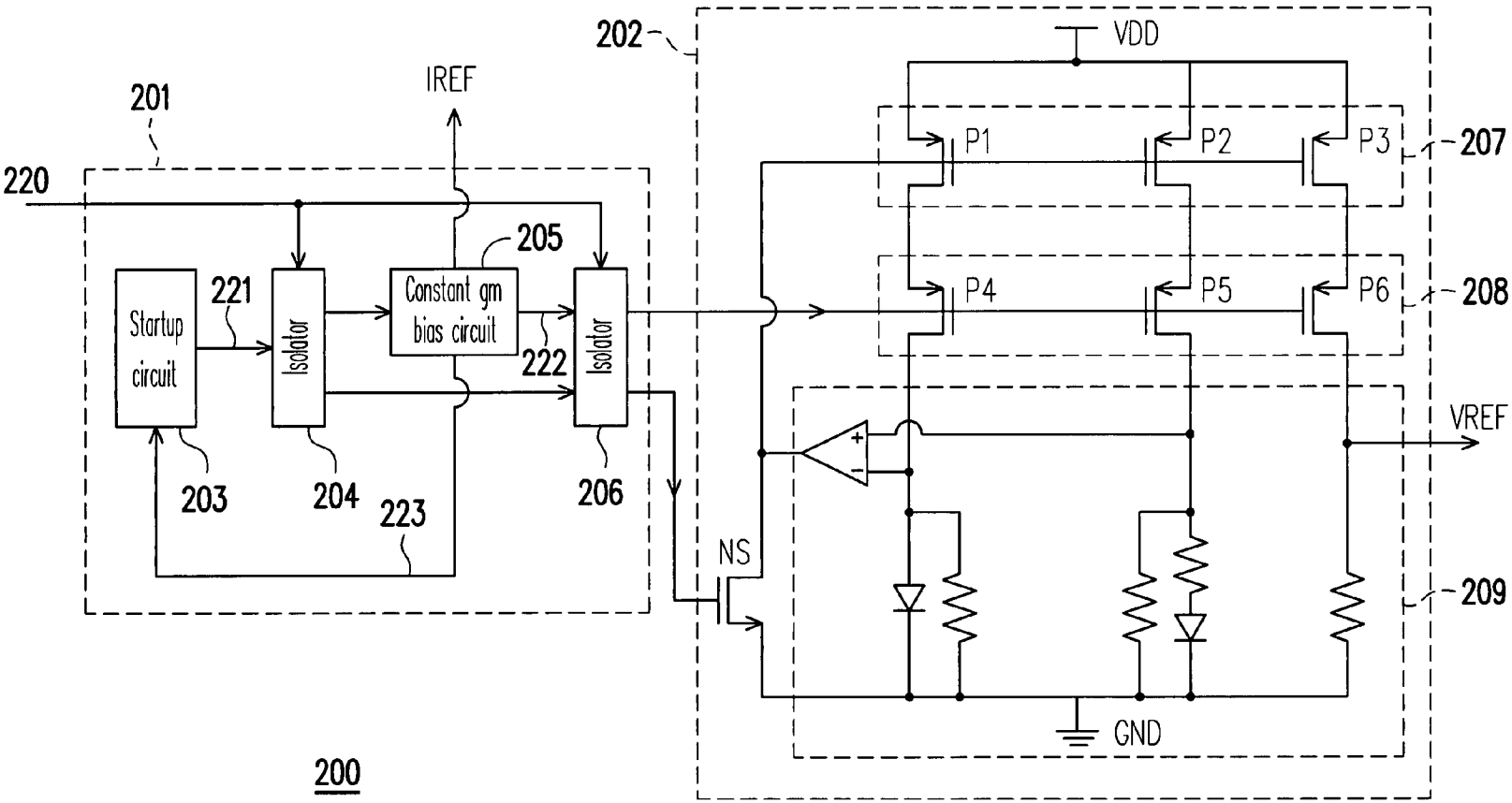
FIG. 2 is a schematic circuit diagram of a circuit for reference current and voltage generation according to an embodiment of the present invention.

FIG. 2 is a schematic circuit diagram of a circuit for reference current and voltage generation 200 according to an embodiment of the present invention. The circuit for reference current and voltage generation 200 comprises a current bias circuit 201 and a voltage reference circuit 202 that are electrically coupled with each other.

The current bias circuit 201 comprises a startup circuit 203, an isolator 204, a constant gm bias circuit 205, and an isolator 206. Wherein, the isolator 204 is electrically coupled to the startup circuit 203. The constant gm bias circuit 205 is electrically coupled to the startup circuit 203 and the isolator 204. The isolator 206 is electrically coupled to the constant gm bias circuit 205 and the isolator 204.

On the other hand, the voltage reference circuit 202 comprises switch circuits 207 and 208, a startup transistor NS (that is an NMOS transistor in the present embodiment), and a bandgap reference circuit 209. Wherein, the switch circuit 207 is electrically coupled to a voltage source VDD. The switch circuit 208 is electrically coupled to the switch circuit 207 and the isolator 206. The startup transistor NS is electrically coupled to the isolator 206 and the switch circuit 207. Finally, the bandgap reference circuit 209 is electrically coupled between the switch circuits 207 and 208, the startup transistor NS, and a ground GND.

The circuit for reference current and voltage generation 200 may be either in a state of turned-on or a state of turned-off. When the circuit is in the turned-on state, the isolators 204 and 206 connect the startup circuit 203, the constant gm bias circuit 205, and the bandgap reference circuit 209. Meanwhile, the constant gm bias circuit 205 enters into the turned-on state and provides a reference current IREF. In addition, the bandgap reference circuit 209 also enters into the turned-on state and provides a reference voltage VREF. On the other hand, when the circuit for reference current and voltage generation 200 is in the turned-off state, the isolators 204 and 206 will block the current flowing through the startup circuit 203, the constant gm bias circuit 205, and the bandgap reference circuit 209. Meanwhile, the constant gm bias circuit 205 and the bandgap reference circuit 209 enter into the turned-off state, and the bias current in the constant gm bias circuit 205 and the bandgap reference circuit 209 will approach to 0. The turn-on and turn-off processes of the circuit for reference current and voltage generation 200 is described in greater detail hereinafter.

When the circuit for reference current and voltage generation 200 is in the turned-off state and the power voltage had increased to a certain amount of constant voltage, the circuit for reference current and voltage generation 200 starts to operate. First, the enable signal 220 enters into an enabling state, thus the isolators 204 and 206 will connect the startup circuit 203, the constant gm bias circuit 205, and the bandgap reference circuit 209. Then, the constant gm bias circuit 205 provides a state signal 223 to the startup circuit 203. Wherein, the content of the state signal 223 reflects the current state of the constant gm bias circuit 205. Meanwhile, the constant gm bias circuit 205 is still turned off, thus the state signal 223 is also in the turned-off state.

Once the startup circuit 203 receives the state signal 223 of the turned-off state, a startup signal 221 is provided by the startup circuit 203. Then, the isolator 204 transmits the received startup signal 221 to the constant gm bias circuit 205. After receiving the startup signal 221, the constant gm bias circuit 205 enters into the turned-on state and provides the reference current IREF and the bias signal 222. Finally, the isolator 206 transmits the bias signal 222 to the switch circuit 208, such that the switch circuit 207 and the bandgap reference circuit 209 are connected by the switch circuit 208.

On the other hand, the isolators 204 and 206 transmit the startup signal 221 of the startup circuit 203 to the startup transistor NS, which turns on the startup transistor NS accordingly. After turning on the startup transistor NS, the switch circuit 207 is controlled by the low potential on the drain of the startup transistor NS to connect the path between the voltage source VDD and the switch circuit 208. Meanwhile, the startup transistor NS, the switch circuits 207 and 208 are all connecting, and the bandgap reference circuit 209 enters into the turned-on state and provides the reference voltage VREF.

Afterwards, if the circuit for reference current and voltage generation 200 desires to change its state from turned-on to turned-off, first the enable signal 220 enters into the disabling state, thus the isolators 204 and 206 block the current flowing through the startup circuit 203, the constant gm bias circuit 205, and the bandgap reference circuit 209. And then a third predetermined voltage is provided by the isolator 204 to turn off the constant gm bias circuit 205. Although the startup circuit 203 is controlled by the state signal 223 to provide the startup signal 221, since the startup circuit 203 and the constant gm bias circuit 205 had been isolated by the isolator 204, the constant gm bias circuit 205 will not be turned on again.

On the other hand, a first predetermined voltage and a second predetermined voltage are provided by the current bias circuit 201 to turn off the voltage reference circuit 202. More particularly, the first predetermined voltage is provided by the isolator 206 to turn off the switch circuit 208, and the second predetermined voltage is also provided to turn off the startup transistor NS. Once the startup transistor NS is turned off (disconnecting), the switch circuit 207 becomes disconnecting immediately. Meanwhile, since the startup transistor NS and the switch circuits 207 and 208 are all disconnecting, the bandgap reference circuit 209 enters into the turned-off state.

Figure 3:
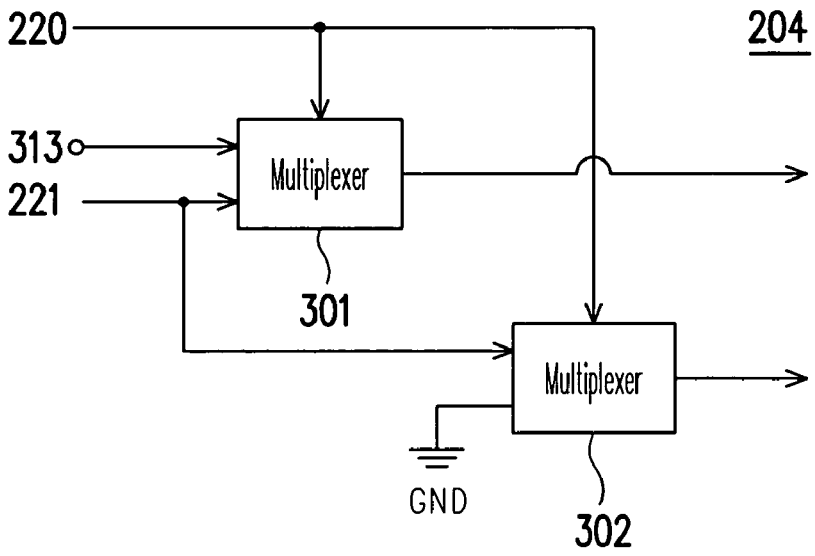
FIG. 3 and FIG. 4 are the schematic circuit diagrams of the isolators in FIG. 2.

FIG. 3 is a schematic circuit diagram of the isolator 204. Referring to FIG. 3, the isolator 204 mainly comprises two multiplexers 301 and 302, and both of the multiplexers 301 and 302 receive the same enable signal 220. When the enable signal 220 is in the enabling state, the multiplexer 301 transmits the startup signal 221 provided by the startup circuit 203 to the constant gm bias circuit 205, whereas the multiplexer 302 transmits the startup signal 221 to the isolator 206. Contrarily, when the enable signal 220 is in the disabling state, the multiplexer 301 transmits a third predetermined voltage 313 to the constant gm bias circuit 205, whereas the multiplexer 302 connects the path between its output terminal and the ground GND. As shown in FIG. 2 and FIG. 3, when the enable signal 220 is in the disabling state, the isolator 204 can physically isolate the startup circuit 203, the constant gm bias circuit 205, and the isolator 206.

Figure 4:
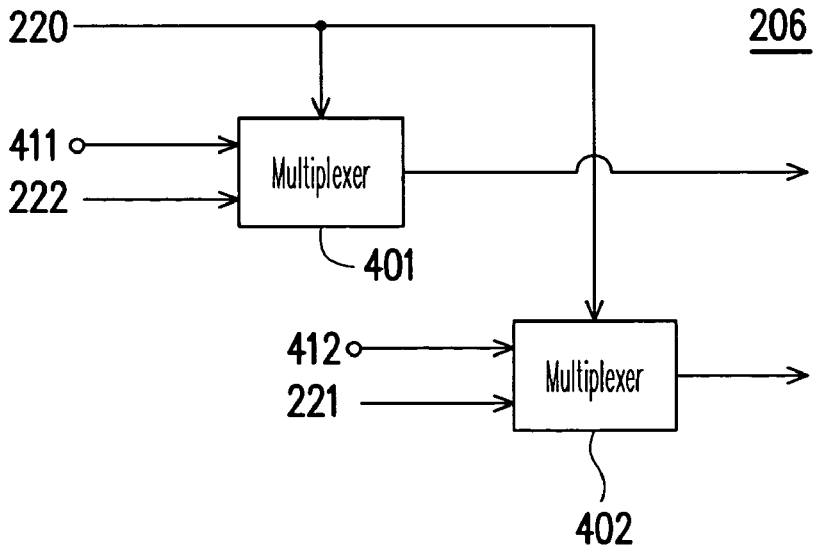

FIG. 4 is a schematic circuit diagram of the isolator 206. Referring to FIG. 4, the isolator 206 mainly comprises two multiplexers 401 and 402, and both of the multiplexers 401 and 402 receive the same enable signal 220. When the enable signal 220 is in the enabling state, the multiplexer 401 transmits the bias signal 222 provided by the constant gm bias circuit 205 to the switch circuit 208, whereas the multiplexer 402 transmits the startup signal 221 provided by the multiplexer 302 to the startup transistor NS. Contrarily, when the enable signal 220 is in the disabling state, the multiplexer 401 transmits a first predetermined voltage 411 to the switch circuit 208, whereas the multiplexer 402 transmits a second predetermined voltage 412 to the startup transistor NS. As shown in FIG. 2 and FIG. 4, when the enable signal 220 is in the disabling state, the isolator 206 can physically isolate the constant gm bias circuit 205, the isolator 204, and the bandgap reference circuit 209.

Figure 5:
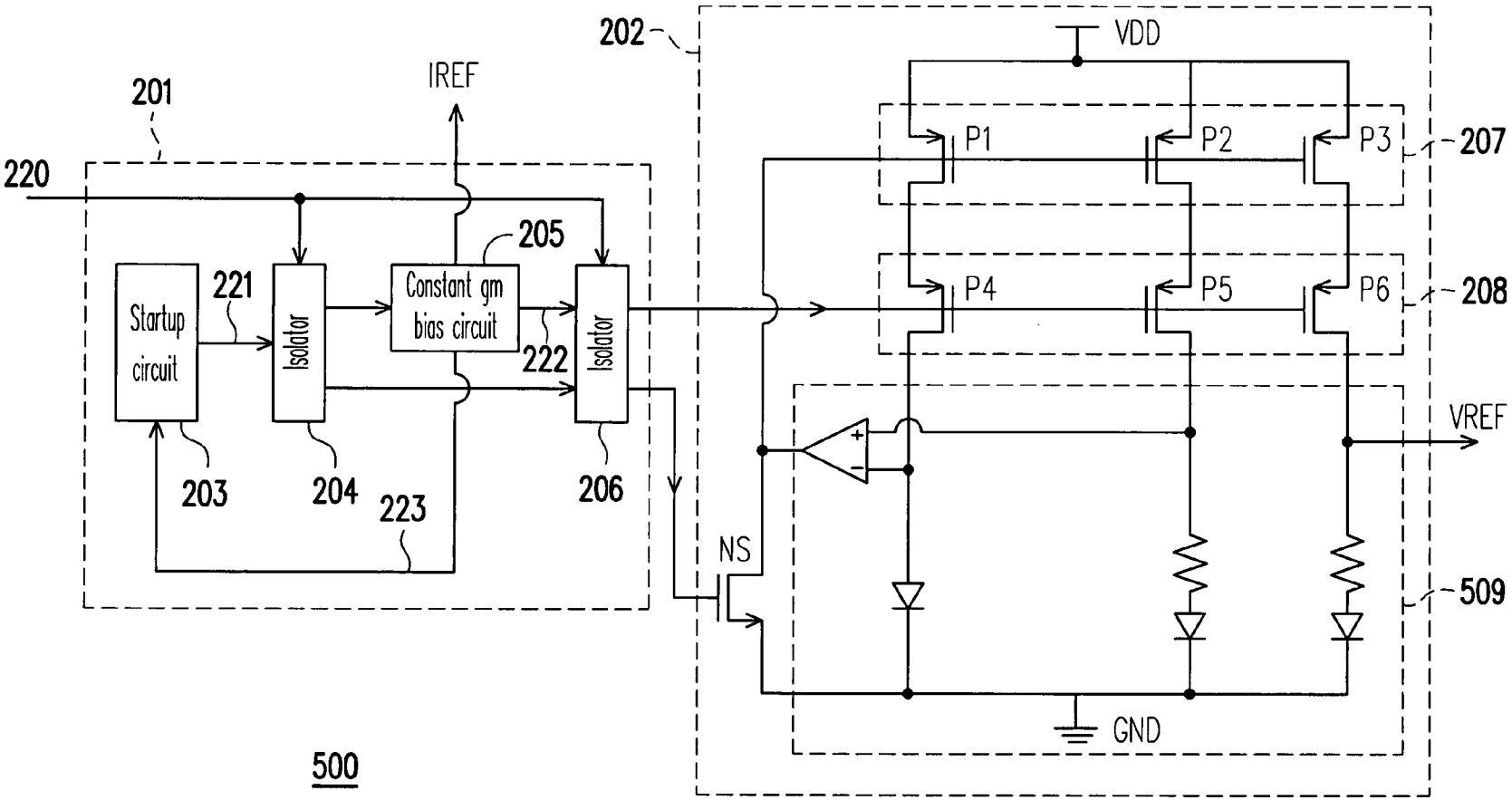
FIG. 5 is a schematic circuit diagram of a circuit for reference current and voltage generation according to another embodiment of the present invention.

FIG. 5 is a schematic circuit diagram of a circuit for reference current and voltage generation 500 according to another embodiment of the present invention. The major difference from the circuit 200 in FIG. 2 to the circuit 500 is that the bandgap reference circuit 209 is replaced with the bandgap reference circuit 509 in FIG. 5. Apart from the bandgap reference circuit 509, the circuit 500 has the same architecture as the circuit 200 in FIG. 2. The circuit for reference current and voltage generation 500 also has the same turn-on and turn-off processes as those of the circuit for reference current and voltage generation 200 in FIG. 2.

In summary, in the present invention, a startup circuit is configured to turn on the constant gm bias circuit, and the startup circuit and a constant gm bias circuit are further configured to turn on a bandgap reference circuit. Regarding to the turn-off function, in the present invention, a predetermined voltage provided by the isolator is used to turn off the constant gm bias circuit and the bandgap reference circuit. Accordingly, the present invention can provide complete turn-on and turn-off functions.

Moreover, when the circuit is turned off, the isolator of the present invention isolates the startup circuit, the constant gm bias circuit, and the bandgap reference circuit, which completely blocks the current. Accordingly, the circuit for reference current and voltage generation provided by the present invention does not consume any current when it is turned off, which significantly extends the usage time of the hand-held electronic apparatus. Furthermore, since the BJT transistor is not required in the present invention, the present invention can be embodied merely by the CMOS manufacturing process.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A circuit for reference current and voltage generation, comprising:

a current bias circuit receiving an enable signal, wherein when the enable signal is in an enabling state, the current bias circuit provides a reference current, a bias signal, and a startup signal, and when the enable signal is in a disabling state, the current bias circuit provides a first predetermined voltage and a second predetermined voltage; and a voltage reference circuit electrically coupled to the current bias circuit, wherein the voltage reference circuit enters into a turned-on state and provides a reference voltage after receiving the bias signal and the startup signal, and enters into a turned-off state after receiving the first predetermined voltage and the second predetermined voltage;

wherein the current bias circuit further comprises:

a startup circuit receiving a state signal and outputting the startup signal when the state signal is in a turned-off state;

a first isolator receiving the enable signal and receiving the startup signal from the startup circuit, wherein when the enable signal is in the enabling state, the first isolator provides the startup signal, and when the enable signal is in the disabling state, the first isolator provides a third predetermined voltage;

a constant gm bias circuit electrically coupled to the first isolator and providing the state signal to the startup circuit according to a state of the constant gm bias circuit, wherein the constant gm bias circuit enters into the turned-on state and provides the reference current and the bias signal after receiving the startup signal from the first isolator, and enters into the turned-off state after receiving the third predetermined voltage from the first isolator; and a second isolator receiving the enable signal, wherein when the enable signal is in the enabling state, the second isolator transmits the bias signal provided by the constant gm bias circuit to the voltage reference circuit and transmits the startup signal provided by the first isolator to the voltage reference circuit, whereas when the enable signal is in the disabling state, the second isolator provides the first predetermined voltage and the second predetermined voltage to the voltage reference circuit.

2. The circuit for reference current and voltage generation of claim 1, wherein when the constant gm bias circuit enters into the turned-on state, the state signal also enters into the turned-on state, and when the constant gm bias circuit enters into the turned-off state, the state signal also enters into the turned-off state.

3. The circuit for reference current and voltage generation of claim 1, wherein when the enable signal is in the disabling state, the first isolator isolates the startup circuit, the constant gm bias circuit, and the second isolator, and the second isolator isolates the constant gm bias circuit, the first isolator, and the voltage reference circuit.

4. The circuit for reference current and voltage generation of claim 1, wherein the first isolator further comprises:

a first multiplexer receiving the third predetermined voltage and receiving the startup signal from the startup circuit, and transmitting one of the third predetermined voltage and the startup signal to the constant gm bias circuit according to the enable signal.

5. The circuit for reference current and voltage generation of claim 1, wherein the first isolator further comprises:

a second multiplexer receiving the startup signal from the startup circuit and transmitting the startup signal to the second isolator when the enable signal is in the enabling state.

6. The circuit for reference current and voltage generation of claim 1, wherein the second isolator further comprises:

a third multiplexer receiving the first predetermined voltage and receiving the bias signal from the constant gm bias circuit, and transmitting one of the first predetermined voltage and the bias signal to the voltage reference circuit according to the enable signal.

7. The circuit for reference current and voltage generation of claim 1, wherein the second isolator further comprises:

a fourth multiplexer receiving the second predetermined voltage and receiving the startup signal from the first isolator, and transmitting one of the second predetermined voltage and the startup signal to the voltage reference circuit according to the enable signal.

8. A circuit for reference current and voltage generation, comprising:

a current bias circuit receiving an enable signal, wherein when the enable signal is in an enabling state, the current bias circuit provides a reference current, a bias signal, and a startup signal, and when the enable signal is in a disabling state, the current bias circuit provides a first predetermined voltage and a second predetermined voltage; and a voltage reference circuit electrically coupled to the current bias circuit, wherein the voltage reference circuit enters into a turned-on state and provides a reference voltage after receiving the bias signal and the startup signal, and enters into a turned-off state after receiving the first predetermined voltage and the second predetermined voltage;

wherein the voltage reference circuit further comprises:

a startup transistor electrically coupled to the current bias circuit and a ground;

a first switch circuit electrically coupled to a voltage source and the startup transistor;

a second switch circuit electrically coupled to the current bias circuit and the first switch circuit; and a bandgap reference circuit electrically coupled to the second switch circuit and the startup transistor; wherein the startup transistor receives one of the startup signal and the second predetermined voltage from the current bias circuit, connects the first switch circuit, the bandgap reference circuit, and the ground after receiving the startup signal, and disconnects the first switch circuit, the bandgap reference circuit, and the ground after receiving.the second predetermined voltage;

the first switch circuit either connects or disconnects the voltage source and the second switch circuit according to a state (turned-on or turned-off) of the startup transistor;

the second switch circuit receives one of the bias signal and the first predetermined voltage from the current bias circuit, connects the first switch circuit and the bandgap reference circuit after receiving the bias signal, and disconnects the first switch circuit and the bandgap reference circuit after receiving the first predetermined voltage;

when the startup transistor, the first switch circuit, and the second switch circuit are all connecting, the bandgap reference circuit enters into the turned-on state and provides the reference voltage;

when the startup transistor, the first switch circuit, and the second switch circuit are all disconnecting, the bandgap reference circuit enters into the turned-off state.

9. The circuit for reference current and voltage generation of claim 8, wherein when the startup transistor is connecting, the first switch circuit connects the voltage source and the second switch circuit, and when the startup transistor is disconnecting, the first switch circuit disconnects the voltage source and the second switch circuit.

* * * * *